US007315243B1

(12) United States Patent
Speakman et al.

(10) Patent No.: US 7,315,243 B1
(45) Date of Patent: Jan. 1, 2008

(54) PERIMETER CONTAINMENT SYSTEM AND METHOD OF USE THEREOF

(75) Inventors: Warner E. Speakman, Oakland, TN (US); Frederick D. Sexton, Jr., Lakeland, TN (US); Lester W. Mikles, Bartlett, TN (US); Glen F. Turner, Toone, TN (US)

(73) Assignee: STI, Inc., Memphis, TN (US)

( * ) Notice: Subject to any disclaimer, the term of this patent is extended or adjusted under 35 U.S.C. 154(b) by 195 days.

(21) Appl. No.: 11/195,980

(22) Filed: Aug. 3, 2005

(51) Int. Cl.
*G08B 1/08* (2006.01)

(52) U.S. Cl. ..... 340/539.13; 340/539.16; 340/573.1

(58) Field of Classification Search ..... 340/539.1, 340/539.11, 539.13, 539.15, 539.16, 539.17, 340/539.22, 564, 573.1; 455/419, 421, 456.1; 705/5; 706/60
See application file for complete search history.

(56) References Cited

U.S. PATENT DOCUMENTS

| | | | | |
|---|---|---|---|---|
| 6,246,320 | B1 * | 6/2001 | Monroe | 340/506 |
| 6,437,696 | B1 | 8/2002 | Lemelson et al. | |
| 6,581,546 | B1 * | 6/2003 | Dalland et al. | 119/712 |
| 6,700,492 | B2 * | 3/2004 | Touchton et al. | 340/573.1 |
| 6,873,261 | B2 | 3/2005 | Anthony et al. | |
| 6,898,521 | B2 | 5/2005 | Yanai | |
| 6,970,183 | B1 * | 11/2005 | Monroe | 348/143 |
| 7,181,228 | B2 * | 2/2007 | Boesch | 455/456.1 |
| 7,184,907 | B2 * | 2/2007 | Chun | 702/69 |

OTHER PUBLICATIONS

Phoenix Contact, Inc. data sheet entitled "RAD-ISM-900-DATA-BD; RAD-ISM-900-RD232-BD Quick Start Guide 1945A"; Feb. 2004; pp. 1-2.
OMRON Electronics, LLC data sheet entitled "CS1-H Controller"; pp. 1-6.
Phoenix Contact, Inc. data sheet entitled "¼ Wave Whip Antenna With 6' Cable"; p. 1.
Phoenix Contact, Inc. data sheet entitled "Surge Voltage Protection Adapter for Mobile Phone and Radio Link Systems Coaxtrab"; pp. 1-3.
OMRON Electronics, LLC "Product Overview—CS1 Series, CS1 Basic I/O Modules"; pp. 1-3.
STI, Inc. data sheet entitled "Multiplex Board; Model #MPX-48/48"; pp. 1-2.
Phoenix Contact, Inc. "RAD-ISM-900 Data Radio Series User Manual—RAD-ISM-900-RS232-BD; RAD-ISM-900-DATA-BD; RAD-ISM-900-DATA-BD-BUS"; Feb. 2005, pp. 1-90.

* cited by examiner

*Primary Examiner*—Van T. Trieu
(74) *Attorney, Agent, or Firm*—Wyatt, Tarrant & Combs, LLP

(57) ABSTRACT

The present invention is a perimeter containment system and method of use thereof having a control center, perimeter contact units, and a perimeter structure. The invention is designed to reduce human error and misinformation during emergency situations. The invention includes a method of monitoring a perimeter such that upon a breach of the perimeter immediate notice is provided to perimeter units so that at least one of the perimeter units may secure the breach. The invention allows a control center to monitor the location of the perimeter units by use of GPS data.

18 Claims, 8 Drawing Sheets

PERIMETER CONTAINMENT SYSTEM AND METHOD OF USE THEREOF

CROSS REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to perimeter containment systems. More specifically, the present invention relates to systems that monitor any area, including a prison, university campus, shopping center parking lot, and the like.

BACKGROUND OF THE INVENTION

In the industry of perimeter containment, a major problem currently existing is that human error commonly results in a breach of a containment system or the lack of a timely correction of the breach. Even a short lag in communication between a control center and a perimeter unit may result in a poor result after the breach has occurred. Specifically, employees may be out of their job described position or unresponsive when a system breach occurs. Unfortunately, rather than informing the control center of such information, an employee may misrepresent his location or misrepresent that which he claims to have visually confirmed.

Even in non-prison settings, such as security efforts at schools, universities and the like, the current perimeter containment systems lack the ability to provide a timely and complete response to a breach. First, there is a lag time associated with the communication between the control center and perimeter unit. Second, as described above, there is human error, in which an employee may intentionally or inadvertently misrepresent his location during an emergency situation. A lag in responsiveness or misinformation results in an inefficient and inoperative security system.

Accordingly, there is a need for a perimeter containment system and method as the one described herein. The invention is designed to reduce the amount of human error associated with such perimeter containment systems and decrease the response time when a security breach occurs.

SUMMARY OF THE INVENTION

The present invention discloses a perimeter containment system. The present invention provides the advantage of allowing actual confirmation of the location of a perimeter vehicle that is monitoring a perimeter structure. Another advantage is the real time communication between the control center and a perimeter vehicle. For example, when an alarm sounds, all perimeter units, as well as the control center, immediately receive notice of the alarm. Further, in addition to the control center having complete GPS data regarding the location of all perimeter units, such information is regularly and frequently recorded into a data base or printed records. The perimeter containment system of the present invention includes a control center, a plurality of perimeter contact units, and a perimeter structure. The control center has a radio communication module, a processing unit, and an interface which requires GPS data in order to operate. The plurality of perimeter contact units are operationally connected to the control center and each perimeter contact unit has a screen, a radio communication module, a multiplex board, and a GPS device.

The present invention also includes a method of containing a perimeter, including predetermining a plurality of zones located outside of the perimeter structure, monitoring the perimeter structure, monitoring through GPS data the position of each perimeter contact unit, communicating through a radio communication module, including two way communication, determining that a breach to the perimeter structure has occurred by use of an alarm, identifying which of the plurality of zones is adjacent to the site of the breach, communicating an alarm to the control center, communicating the alarm from the control center to each of the perimeter contact units, communicating GPS data from the perimeter contact units to the control center, acknowledging by the control center that a perimeter contact unit is present in a zone of the perimeter structure breach, determining that the perimeter structure breach is secure by the perimeter contact unit in the zone of the breach, communicating that the perimeter structure breach is secure from the perimeter contact unit in the zone of the breach to the control center, and resetting the alarm by the control center. Certain embodiments may also include moving at least one of the perimeter contact units into the zone adjacent to the breach, analyzing the site of the breach to the perimeter structure to determine that the breach is corrected, communicating from the perimeter contact unit that the breach is corrected, analyzing the GPS data to determine that the perimeter contact unit is located within the zone adjacent to the breach, and resetting the alarm.

In another embodiment of the present invention, the method of monitoring a perimeter includes predetermining a location of a plurality of zones located adjacent to the perimeter structure, communicating an alarm to the perimeter contact units, wherein the alarm indicates which of the plurality of zones is closest to a breach of the perimeter, communicating GPS data from each perimeter contact unit to the control center, recording GPS data by a processing unit of the control center, moving at least one of the perimeter contact units into the zone closest to the breach, acknowledging by the control center the presence of the perimeter contact unit in the zone closest to the breach, communicating from the perimeter contact unit that the breach is secure, and resetting the alarm.

Accordingly, one aspect of the invention is to provide a perimeter containment system that confirms the GPS positioning of each perimeter vehicle before resetting an alarm.

Another aspect of the invention is to provide a perimeter vehicle the ability to reset an alarm if the perimeter vehicle is located within the zone where the breach to the perimeter structure occurred.

Still another aspect of the invention is to provide a method of containing a perimeter in which there is confirmation that the site of a breach of a perimeter structure was actually monitored to determine whether the breach was corrected.

BRIEF DESCRIPTION OF THE DRAWINGS

FIG. 5A shows the control center attached to a perimeter structure, such as a prison fence. FIG. 5B shows a perimeter contact unit having an antenna.

DETAILED DESCRIPTION OF THE INVENTION

Figure 1:
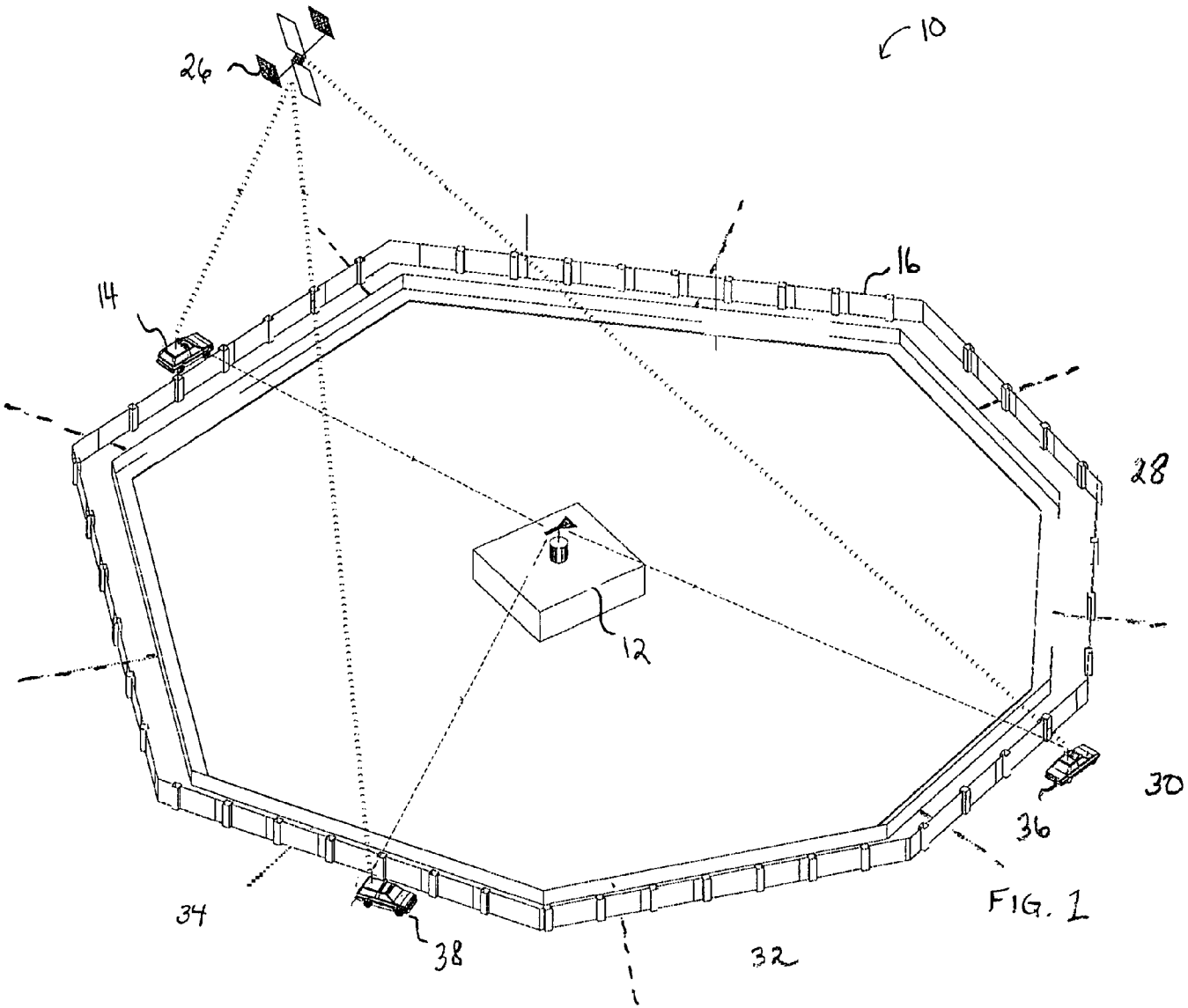
FIG. 1 is a perspective view of the present invention. There is shown the control center, perimeter structure, and perimeter contact units, also called perimeter vehicles. The control center receives GPS data regarding the positioning of the perimeter vehicles from the satellite.

The invention disclosed herein is a perimeter containment system 10. The system 10 has a control center 12, perimeter contact units 14, and a perimeter structure 16. One advantage provided by the present invention is that real time communication between the control center 12 and perimeter contact units 14 is provided with confirmation of the location of each of the perimeter contact units 14. An additional advantage of the present invention is the continuous tracking and recordation of the location of the mobile perimeter contact units 14. Stated another way, the present invention creates a record of the specific location of each perimeter vehicle in the event of a breach of containment. Such perimeter containment systems 10 are useful in many different environments, including, but not limited to, prisons, hospitals, and universities.

Shown in FIG. 1 is an overview of a first embodiment of the present invention. There is shown the perimeter containment system 10 which includes the control center 12, multiple mobile perimeter contact units 14, and a perimeter structure 16. The control center 12 is merely a centrally located communication unit, as further described herein, which communicates with the mobile perimeter contact units 14. In certain embodiments of the present invention, the mobile perimeter contact units 14 are vehicles. In alternate embodiments, the mobile perimeter contact units 14 may be alternate mobile units including, but not limited to, cars, trucks, vans, golf carts, or other similar vehicles. In such embodiments, it is necessary that the vehicle include a battery source, such as a 12 volt battery, as the current system operates at about a one half amp to about a one amp load. In certain embodiments of the present invention, the perimeter structure 16 may be a perimeter fence as commonly found around a prison. In alternate embodiments, the perimeter structure 16 may be the boundary of a parking lot, or the boundary of a specific property. In still other embodiments, the perimeter structure 16 may merely be a reference to a specific location, rather than an actual structure. In certain embodiments, the invention disclosed herein may be a stand alone system which is not interfaced with the perimeter structure 16, which may be used to monitor locations of perimeter contact units 14 in predetermined zones.

Figure 2:
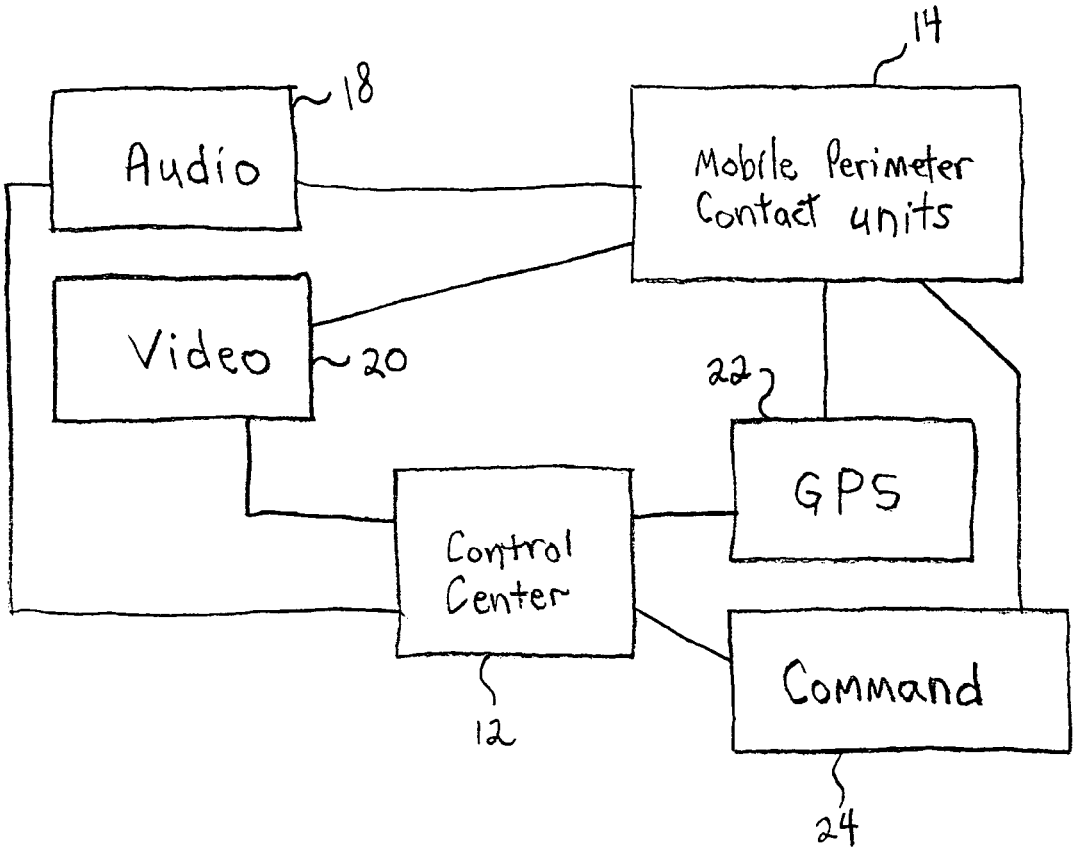
FIG. 2 is a schematic diagram of the types of communications sent from and received by the control center and the perimeter contact units, such as perimeter vehicles.

Shown in FIG. 2 is a flow diagram of the perimeter containment system 16. Regarding communication between the control center 12 and each of the mobile perimeter contact units 14, audio transmissions 18, and video transmissions 20 are available. In certain embodiments, video transmissions 20 include video from a camera on the mobile perimeter contact unit 14, or a camera on the actual vehicle which is operationally connected to the perimeter contact unit 14 so that it transmits to the control center 12. As further described herein those transmissions are encrypted such that secure transmissions result. FIG. 2 also shows that the control center 12 receives GPS data 22 from a satellite 26 and may send command transmissions 24 in order to open or close doors, move cameras, zoom in or out of camera shots and the like. Command transmissions 24 also include receiving an alarm and silencing that alarm. Also shown in FIG. 2 is the ability of the mobile perimeter contact units 14 to receive and send command transmissions 24. Accordingly, when an alarm sounds, all perimeter contact units 14 receive the signal and may reset the alarm, but only if that perimeter contact unit 14 is located within a specific area, or zone, as further described herein. The perimeter contact unit 14 may reset the alarm from anywhere.

Referring back to FIG. 1, there is shown a first embodiment in which a plurality of zones are established by the GPS data 22. For example, if an alarm sounded in a first zone 28 due to an open gate then the first vehicle 36 would receive a command transmission 24 indicating a breach to the perimeter structure 16. The first vehicle 36 would not be able to reset the alarm given its current location in the second zone 30. However, upon transit from the second zone 30 to the first zone 28, the first vehicle 36 could reset the alarm. Likewise, the second vehicle 38, located in the fourth zone 34 could not reset the alarm regarding a breach of the perimeter structure 16 in the first zone 28. This embodiment of the present invention requires that each alarm be reset only after a mobile perimeter contact unit 14 is located within the same zone.

Figure 3:
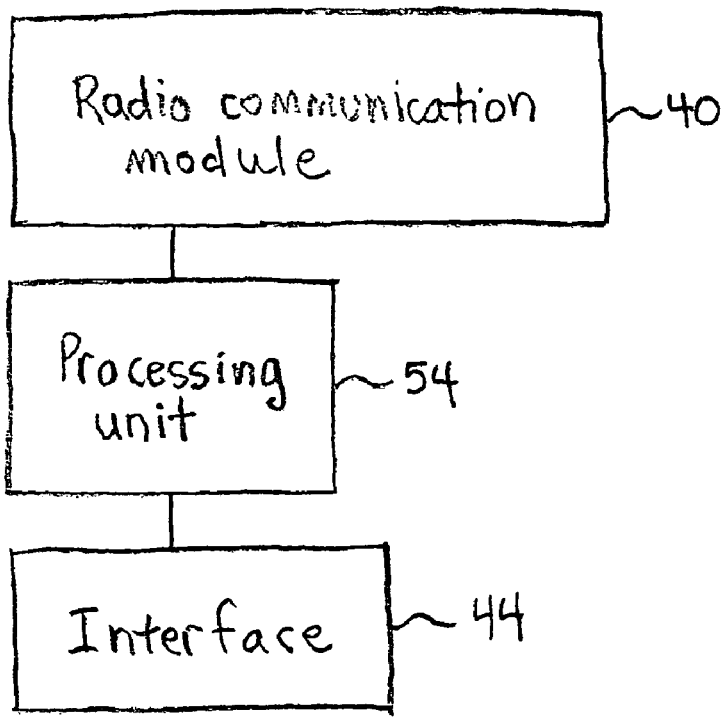
FIG. 3 is a schematic diagram of a first embodiment of the control center. Shown there is connection of the radio communication module, PLC unit, and interface.

Referring now to FIG. 3, there is shown a schematic of the control center 12. In certain embodiments, the control center 12 includes a radio communication module 40, a processing unit 54, and an interface 44. The processing unit 54 may be a PLC unit or a CPU. In certain embodiments of the present invention, the processing unit 54 may be, for example, a PLC unit such as an OMRON PLC which is available from OMRON Electronics, LLC, One Commerce Drive, Schaumburg, Ill. 60173. In certain embodiments, communications through the radio communication module 40 may be encrypted for security purposes. In such embodiments, the encryption may be provided by the radio communication module 40, for example the model available from Phoenix Contact, Inc., which is described below. In other embodiments, one of ordinary skill in the art is aware of other ways of encrypting for security purposes.

Each of the other components is also readily commercially available. For example, the radio communication module 40 is available as RAD-ISM-900 Data Radio Series Model RS-485 from Phoenix Contact, Inc., P.O. Box 4100, Harrisburg, Pa. 17111-0100. The radio communication module 40 may be an equivalent of the above-listed module. In certain embodiments, the radio communication module 40 is a radio frequency transmitter and receiver. In certain embodiments, the radio communication module 40 may be a module which performs the functions disclosed herein. In certain embodiments, communication through the radio communication module 40 may be at about 900 mHz or about 2.4 gHz. Such a radio communication module 40 includes two way communication by audio, visual, and other communications resulting in the manipulation of the perimeter structure, such as opening or closing gates or doors, moving security cameras, or the like. The interface 44 is merely a personal computer and screen which are readily available from a variety of sources. An example of an interface 44 is a computer with a pentium IV, 2.0 gHz, and 1 GB ram. An example of the screen is a Viewsonic LCD monitor. The listed parts of the control center 12 are operably connected as known to one of ordinary skill in the art.

Figure 4:
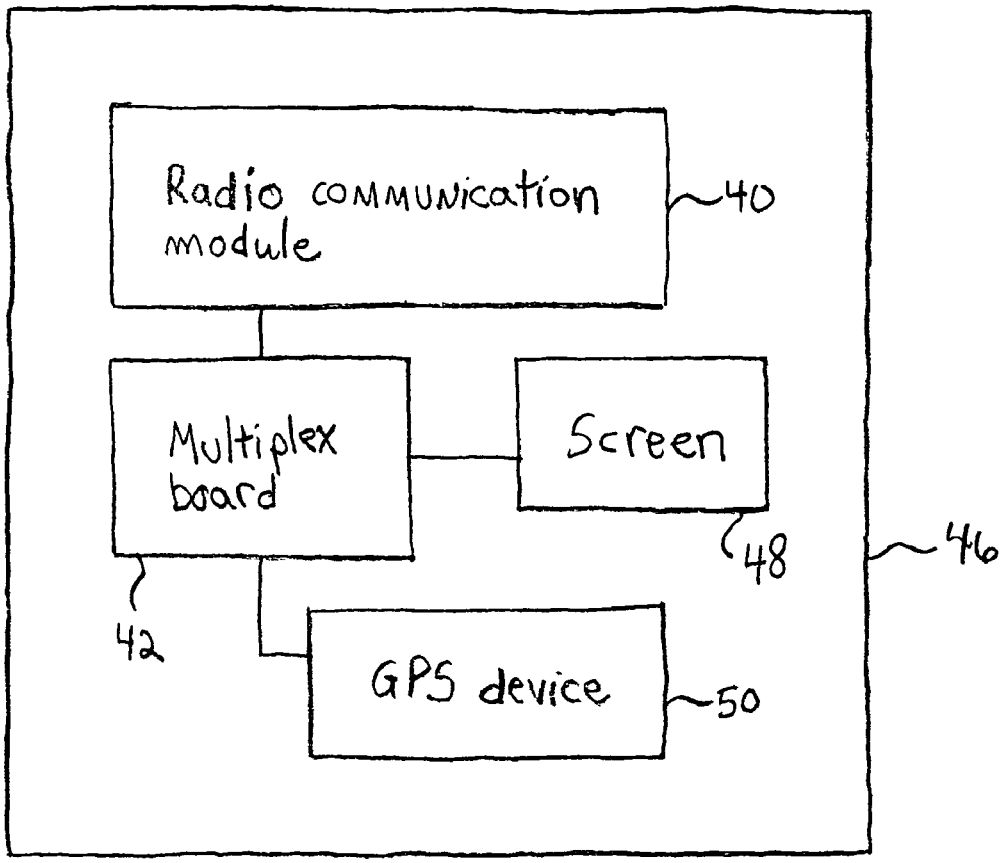
FIG. 4 is schematic diagram of a first embodiment of a perimeter contact unit, such as the box placed in each vehicle used to monitor the perimeter structure. The perimeter contact unit includes a housing surrounding a radio communication module, multiplex board, GPS device, and screen.

Referring now to FIG. 4, there is shown a perimeter contact unit 14. Each perimeter contact unit 14 includes a housing 46 having a screen 48, a multiplex board 42, a radio communication module 40, and a GPS device 50. In certain embodiments, the screen 48 shows a map of the perimeter structure 16 and other components. In certain embodiments, the screen 48 may be a plastic sheet with a luminescent background. Construction of such a screen is known by those of ordinary skill in the art. The housing 46 is a metal, plastic or other rigid material which encloses the remainder of the components, other than the screen 48. The housing 46 makes the perimeter contact unit a unitary structure which is easily installed in a vehicle, as further discussed below. The parts of the perimeter contact unit 14 are commercially available as indicated above. Further, the multiplex board 42 is available as Model MPX-48/48 from STI, Inc., 1877 Vanderhorn Drive, Memphis, Tenn. 38134 and is described in the Model #MPX-48/48 product description sheet, which is hereby incorporated herein by reference. In certain embodiments, the multiplex board 42 is a graphic panel remote interfacing board. In certain embodiments, the multiplex board 42 may be a multiplex board which is a microprocessor-based circuit designed to reduce the amount of wiring between remote locations. In that embodiment, the board has the following characteristics. The board may have 48 inputs and 48 outputs, which reduce the number of conductors from 98 to two twisted pairs. The circuit may be designed to be fiber optic compatible. Outputs are available for circuit status annunciation and acknowledgement. Integrated circuits are socketed and all board connections may be made with plug-in type connectors. Communication medium may be selectable by plug-on communication module. Input power shall be reverse polarity protected and fused. A single input to master unit may be capable of turning on all outputs on slave units. With respect to the GPS device 50, it needs to be a NMEA qualified GPS device. In certain embodiments, for example, the GPS device 50 may be one of several models available from Motorola, for example Model FS Encore. In certain embodiments, the GPS device 50 may be an embedded device, for example embedded in the multiplex board 42. The parts of the perimeter contact unit 14 are readily assembled as known by those of ordinary skill in the art. The perimeter contact unit 14 may be mounted in a vehicle, or other mode of transportation, so that it is mobile relative to the perimeter structure 16 as shown in FIG. 1. The various connections which are necessary for the parts of the control center 12 and perimeter contact units 14 may be accomplished by use of connections or cables commercially available from Omron Electronics, LLC, One Commerce Drive, Schaumburg, Ill. 60173. In certain embodiments of the present invention, a surge voltage protection adapter for mobile phone or radio link systems may be used. An example of such an adapter is the COAXTRAB model from Phoenix Contact GmbH & Co. KG, 32823 Blomberg, Germany. In still other embodiments of the present invention, an antenna 52 may be attached to the radio communication module 40 or the GPS device 50. Such an antenna 52 is commercially available, for example, from Phoenix Contact, Inc. P.O. Box 4100, Harrisburg, Pa. 17111 as a one quarter wave whip antenna with six foot cable.

Figure 5:
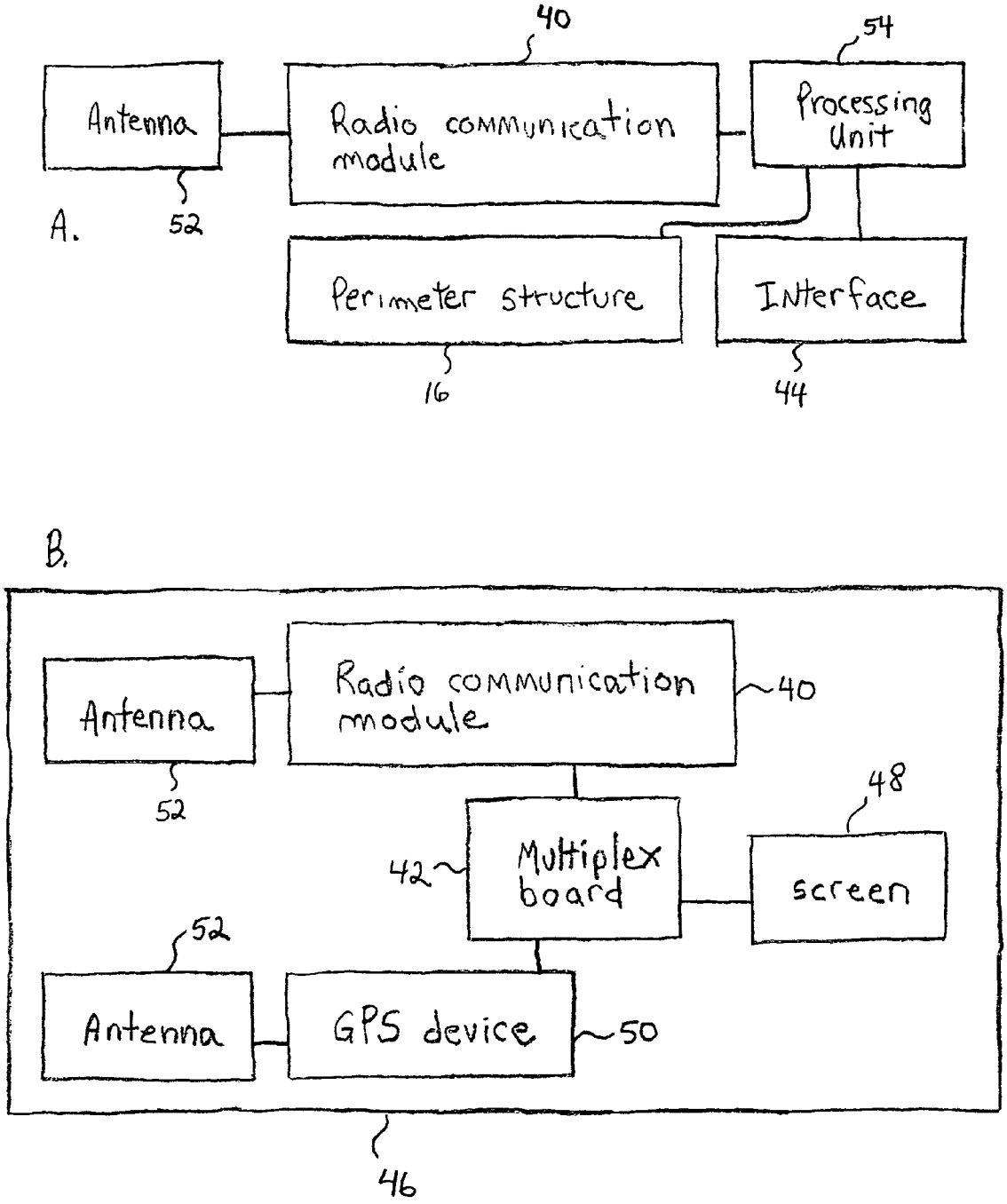
FIGS. 5A and 5B show schematic diagrams of embodiments of the control center and perimeter contact unit, respectively.

Referring now to FIGS. 5A and 5B, there is shown schematic drawings of the arrangement of another embodiment of the control center 12, and a perimeter contact unit 14, respectively. With reference to FIG. 5A, the PLC unit 54 allows the current invention to attach to an existing perimeter structure 16 through standard hard wiring connections. It is noted that the system shown in FIG. 5B is mobile.

In certain embodiments of the present invention, the functions of the components listed above may be directed by source code. One of ordinary skill in the art may generate such code with the use of a C++ programming package. In certain embodiments, the programming code for a processing unit 54, which is a PLC unit, is protocol management language. In certain embodiments, the programming code for a processing unit 54, which is a CPU, is C++. In other embodiments of the present invention, one of ordinary skill may construct source code based upon this disclosure of the functions described herein.

Figure 6:
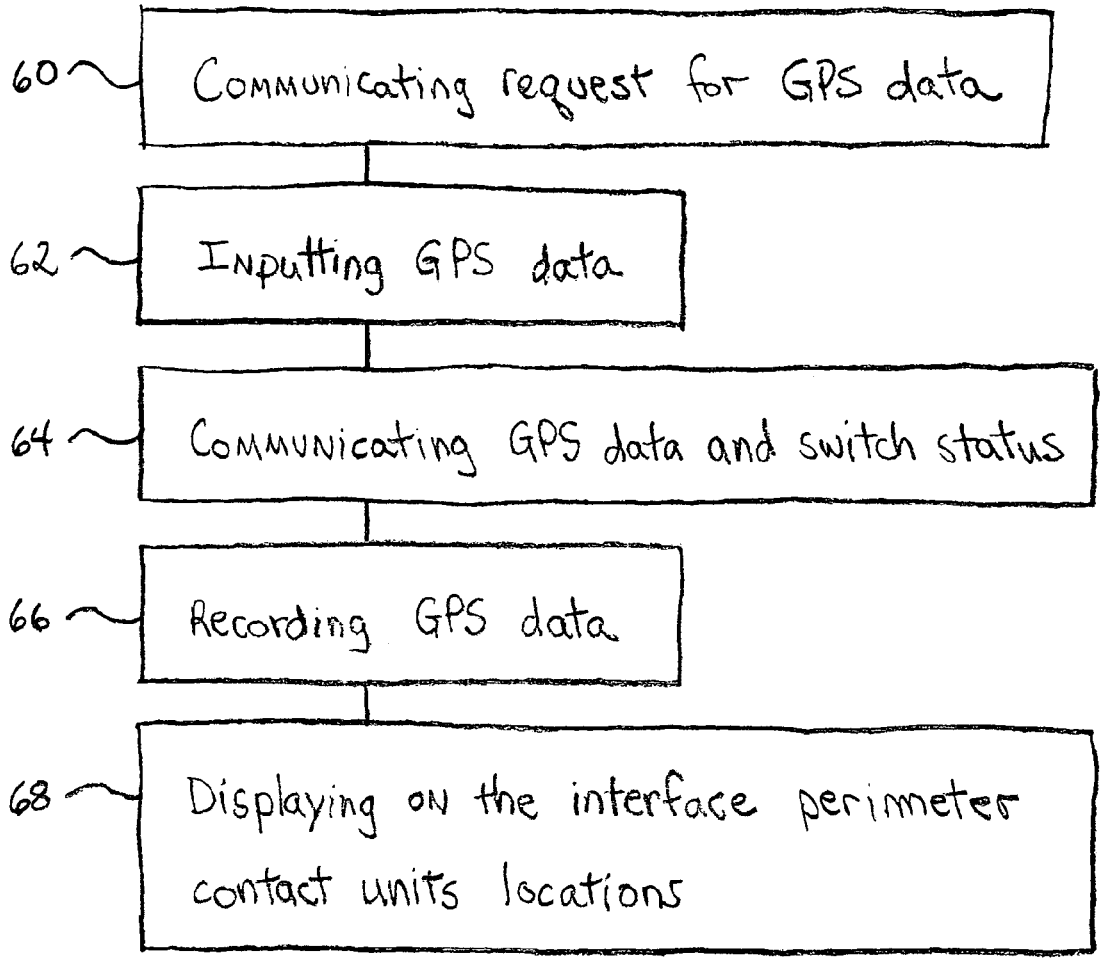
FIG. 6 is a flow chart of a first embodiment of a method of containing a perimeter.

Referring now to FIG. 6, there is shown a flow chart of the steps for monitoring the perimeter containment system 10 when there is no breach of the perimeter structure 16. The process starts by communicating a request 60 from the control center 12 to all perimeter contact units 14 for GPS data 22. The next step is inputting 62 GPS data 22 into each multiplex board 42 of each perimeter contact unit 14 from the GPS device 50 of each unit 14. The next step is communicating 64 GPS data 22 and switch status from each perimeter contact unit 14 to the control center 12. The next step is recording 66 at the control center 12 the GPS data 22 received from each perimeter contact unit 14. In certain embodiments, the GPS data 22 may be recorded at a certain frequency of time (once per second, for example) which may be adjustable. Also, GPS data 22 recordation may occur each time a zone is traversed. The final step is displaying 68 on the interface 44 the location of each perimeter contact unit 14. The frequency of these steps may be adjusted by a user of the system 10. Since no breach of the perimeter structure 16 is detected, the interface 44 at the control center 12 continues to display the changing locations of each perimeter contact unit 14.

Figure 7:
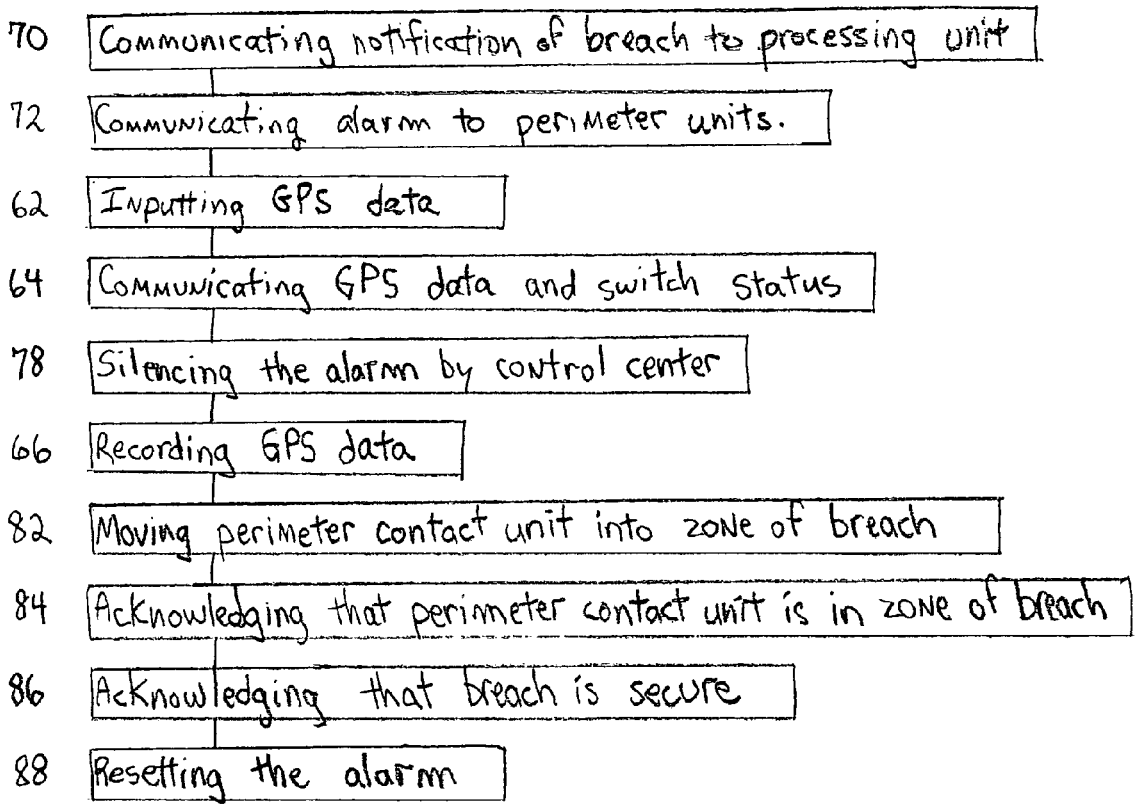
FIG. 7 is a flow chart of another embodiment of the method of containing a perimeter.

Referring now to FIG. 7, there is shown a flow chart of the steps of detecting and correcting a breach to the perimeter structure 16. Prior to taking the steps shown in either FIG. 6 or 7, it is necessary to predetermine a plurality of zones located outside of the perimeter structure 16. Examples of such zones are the zones (28, 30, 32, and 34) shown in FIG. 1. The boundaries of the zones are determined by the individual user of the system 10. However, the boundaries of the zones are established by mapping the GPS coordinates of all boundaries. Those GPS coordinates are entered into the processing unit 54, in a manner known to those of ordinary skill in the art. The processing unit 54 uses those GPS coordinates as reference points and GPS data 22 from any of the perimeter contact units 14 to determine which of the zones each of the perimeter contact units 14 is in.

After the zone boundaries are set, the processing unit 54 monitors the perimeter structure 16. In certain embodiments, the perimeter structure 16 is a prison fence or other sophisticated structure having the ability to communicate when the structure has been compromised. Accordingly, a breach of the perimeter structure 16 is communicated to the processing unit 54. As shown in FIG. 7, when the perimeter structure 16 is breached, the next step is communicating notification 70 of the breach to the processing unit 54. The processing unit 54 then communicates 72 an alarm to each of the perimeter contact units 14. The next step is inputting 62 GPS data 22 into the multiplex board 42 of the perimeter contact unit 14 from the GPS device 50. The next step is communicating 64 GPS data 22 and switch status from each perimeter contact unit 14 to the control center 12. Thereafter, the next step is silencing 78 the alarm by the control center 12. Then, the next step is recording 66 at the control center 12 the GPS data 22 received from each perimeter contact unit 14. The next step is moving 82 a perimeter contact unit 14 into the zone in which the breach occurred. The next step is communicating 64 GPS data 22 and switch status from each perimeter contact unit 14 to the control center 12. Then, the control center 12 acknowledges 84 that a perimeter contact unit 14 is in the zone of the breach. At that point, the control center 12 acknowledges receipt 86 of information from the perimeter contact unit 14 that the breach of the perimeter structure 16 secure and the control center 12 takes the final step of resetting 88 the alarm.

Figure 8:
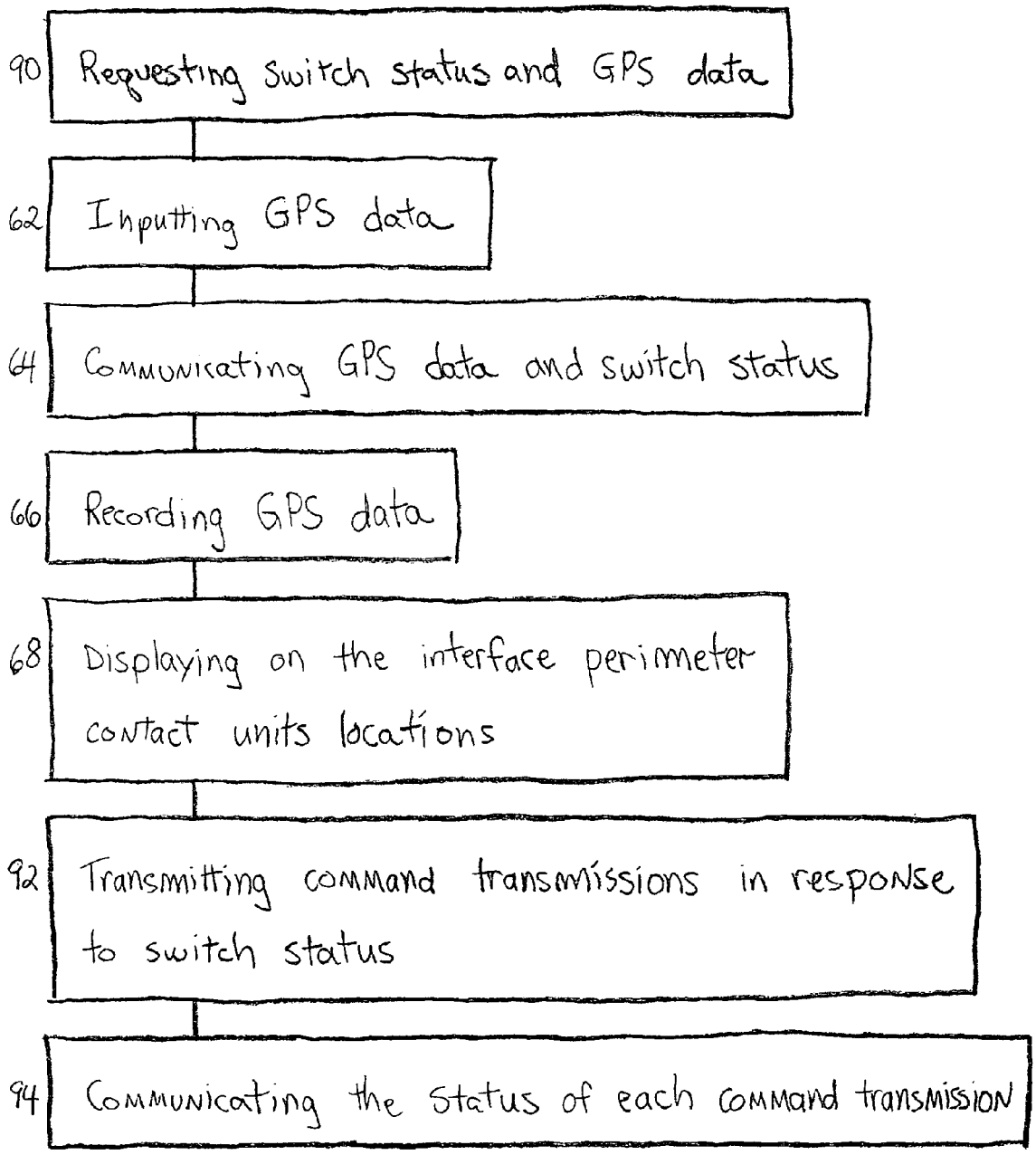
FIG. 8 is a flow chart of still another embodiment of the method of monitoring a perimeter.

Referring now to FIG. 8, there is shown a flow chart of another embodiment of the present invention. In this embodiment, each of the perimeter contact units is allowed autonomy with regard to command transmissions 24. For example, a perimeter contact unit 14 is set up to have the same ability as the control center 12 to initiate command transmissions 24 in order to open gates, doors, reset alarms, and the like. Shown in FIG. 8 is the requesting 90 by the control center 12 of perimeter contact unit 14 switch status and GPS data 22 for each perimeter contact unit 14; inputting 62 GPS data 22 into each multiplex board 42 of each perimeter contact unit 14 from the GPS device 50 of each unit 14; communicating 64 GPS data 22 and switch status from each perimeter contact unit 14 to the control center 12; recording 66 at the control center 12 the GPS data 22 received from each perimeter contact unit 14; displaying 68 on the interface 44 the location of each perimeter contact unit 14; transmitting 92 from the control center 12 the command transmissions 24 in response to the switch status of the perimeter contact units 14; and communicating 94 from the control center 12 to each of the perimeter contact units 14 the status of each command transmission 24.

All references, publications and patents disclosed herein are expressly incorporated by reference.

Thus, it is seen that the perimeter containment system and method of use thereof of the present invention readily achieves the ends and advantages mentioned as well as those inherent therein. While certain preferred embodiments of the invention have been illustrated and described for the purposes of the present disclosure, numerous changes in the arrangement and construction of parts may be made by those skilled in the art, which changes are encompassed within the scope and spirit of the present invention, as defined by the following claims.

What is claimed is:

1. A perimeter containment system, comprising:

a control center, the control center having a radio communication module capable of receiving GPS data, a processing unit operationally connected to the radio communication module, and an interface operationally connected to the processing unit;

a perimeter contact unit operationally connected to the control center, the perimeter contact unit having a multiplex board, a radio communication module operationally connected to the multiplex board, a screen operationally connected to the multiplex board, and a GPS device operationally connected to the multiplex board; and a perimeter structure operationally connected to the processing unit.

2. The perimeter containment system of claim 1, further comprising an antenna operationally connected to the radio communication module.

3. The perimeter containment system of claim 1, further comprising an antenna operationally connected to the GPS device.

4. The perimeter containment system of claim 1, wherein the perimeter structure is a fence.

5. The perimeter containment system of claim 1, wherein the perimeter structure is a property boundary.

6. A method of containing a perimeter, comprising:

predetermining a plurality of zones located outside of a perimeter structure;

monitoring the perimeter structure;

monitoring through GPS data the position of a perimeter contact unit;

communicating through a radio communication module, wherein communicating further comprises two way communication;

communicating an alarm to a control center from a perimeter structure;

communicating from the control center to each of the perimeter contact units the alarm;

communicating GPS data from the perimeter contact units to the control center;

acknowledging by the control center that the perimeter contact unit is present in a zone of the perimeter structure breach;

determining that the perimeter structure breach is secure by the perimeter contact unit in the zone of the breach;

communicating that the perimeter structure breach is secure from the perimeter contact unit in the zone of the breach to the control center;

resetting the alarm.

7. The method of claim 6, further comprising identifying which of the plurality of zones is adjacent to the site of the breach.

8. The method of claim 7, further comprising moving the perimeter contact unit into the zone adjacent to the breach.

9. The method of claim 6, wherein resetting the alarm further comprises resetting the alarm from the control center.

10. The method of claim 6, wherein resetting the alarm further comprises resetting the alarm from the perimeter contact unit.

11. The method of claim 6, wherein communicating through a radio communication module further comprises manipulating the perimeter structure.

12. A method of monitoring a perimeter, comprising:

predetermining a location of a plurality of zones located adjacent to a perimeter structure;

communicating an alarm from a control center to a plurality of perimeter contact units, wherein the alarm indicates a breach of the perimeter structure and which of the plurality of zones is closest to the breach;

communicating GPS data from each of the plurality of perimeter contact units to the control center;

recording GPS data by a processing unit of the control center;

moving at least one of the plurality of perimeter contact units into the zone closest to the breach;

acknowledging by the control center the presence of at least one of the plurality of perimeter contact units in the zone closest to the breach;

communicating from one of the plurality of the perimeter contact units to the control center that the breach is secure; and resetting the alarm.

13. The method of claim 12, further comprising inputting GPS data into each multiplex board of each of the plurality of the perimeter contact units from a GPS device.

14. The method of claim 12, further comprising communicating a switch status from each of the plurality of perimeter contact units to the control center.

15. The method of claim 12, further comprising silencing the alarm from the control center.

16. The method of claim 12, wherein communicating further comprises communicating by use of a radio communication module.

17. The method of claim 12, further comprising silencing the alarm from any of the perimeter contact units.

18. The method of claim 12, further comprising silencing the alarm from the perimeter contact unit in the zone closest to the breach.

* * * * *